US005280807A

United States Patent [19]

Frey et al.

[11] Patent Number: 5,280,807

[45] Date of Patent: Jan. 25, 1994

[54] SUPPLY CIRCUIT FOR A TWO-TUBE HYDRAULIC SYSTEM

[75] Inventors: Heinz Frey, Menziken; Kamil Prochazka, Windisch, both of Switzerland

[73] Assignee: Asea Brown Boveri Ltd., Baden, Switzerland

[21] Appl. No.: 968,497

[22] Filed: Oct. 29, 1992

[30] Foreign Application Priority Data

Nov. 4, 1991 [CH] Switzerland ..... 3203/91

[51] Int. Cl.[5] ..... F15B 13/044; F15B 19/00; F15B 20/00

[52] U.S. Cl. ..... 137/596.15; 137/556; 137/557; 137/596.16; 251/29; 251/30.01

[58] Field of Search ..... 137/556, 557, 596.15, 137/596.16; 251/29, 30.01

[56] References Cited

U.S. PATENT DOCUMENTS

| | | | |
|---|---|---|---|
| 4,103,592 | 8/1978 | Davis . | |
| 4,343,454 | 8/1982 | Kure-Jensen et al. | 251/29 X |
| 4,637,587 | 1/1987 | Kuhnlein | 251/29 |
| 5,095,804 | 3/1992 | Burch | 91/461 X |
| 5,137,253 | 8/1992 | Frey et al. | 251/29 |
| 5,143,119 | 9/1992 | Plangger | 251/29 X |
| 5,217,199 | 6/1993 | Frey | 251/29 |

FOREIGN PATENT DOCUMENTS

| | | |
|---|---|---|
| 0115244 | 8/1984 | European Pat. Off. . |
| 0430089 | 6/1991 | European Pat. Off. . |
| 0433791 | 6/1991 | European Pat. Off. . |
| 0451543 | 10/1991 | European Pat. Off. . |
| 552279 | 3/1943 | United Kingdom . |

OTHER PUBLICATIONS

English language copy of Swiss Patent Application CH 202390-7 (undated).

*Primary Examiner*—Gerald A. Michalsky

*Attorney, Agent, or Firm*—Burns, Doane, Swecker & Mathis

[57] ABSTRACT

A supply circuit for a hydraulic fluid system has at least one pressure generation device, at least one connecting valve, a main line and a safety deactivation unit. The supply circuit permits a hydraulic fluid to be fed in such a way that, in all operating states, occurrence of pressure surges in the system is prevented. The connecting valve is designed as a slide valve with three control edges for regulating filling, operation and testing functions. A plate valve, in fluid communication with the slide control valve, is designed as an outflow amplifier and fulfills the safety related tasks.

9 Claims, 9 Drawing Sheets

SUPPLY CIRCUIT FOR A TWO-TUBE HYDRAULIC SYSTEM

BACKGROUND OF THE INVENTION

1. Field of the Invention

The invention relates to a supply circuit for a two-tube hydraulic system.

2. Discussion of Background

Patent Application CH 2023/90-7 has disclosed a two-tube hydraulic system of the generic type, which is supplied with a hydraulic fluid via a connecting valve designed as a plate valve. This two-tube hydraulic system is used for actuating piston/cylinder arrangements, in particular positioners in the region of the steam feed to a turbine.

Pressure surges in this region have adverse effects, since they can cause instabilities in turbine control. Such pressure surges cannot always be avoided by the existing supply circuits.

SUMMARY OF THE INVENTION

Accordingly, one object of this invention, as defined in the claims, is to provide a novel supply circuit for a two-tube hydraulic system, which allows a hydraulic fluid to be fed in such a way that, in all operating states, occurrence of pressure surges in the system is impossible.

The advantages achieved by the invention are essentially that very fine dosage of the replenishment with hydraulic fluid is possible, particularly when filling the line system, without having to lose high dynamics in the outflow of the hydraulic fluid into the outflow. It is also advantageous that sensitive components which, however, are advantageous for fine control of the replenishment with hydraulic fluid can be used in the supply circuit without having to reduce the safety demands on the supply circuit. This is achieved by using for purposes concerned with safety a plate valve which is designed as an outflow amplifier and constructed with particular regard for operational safety.

Further embodiments of the invention are subjects of the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
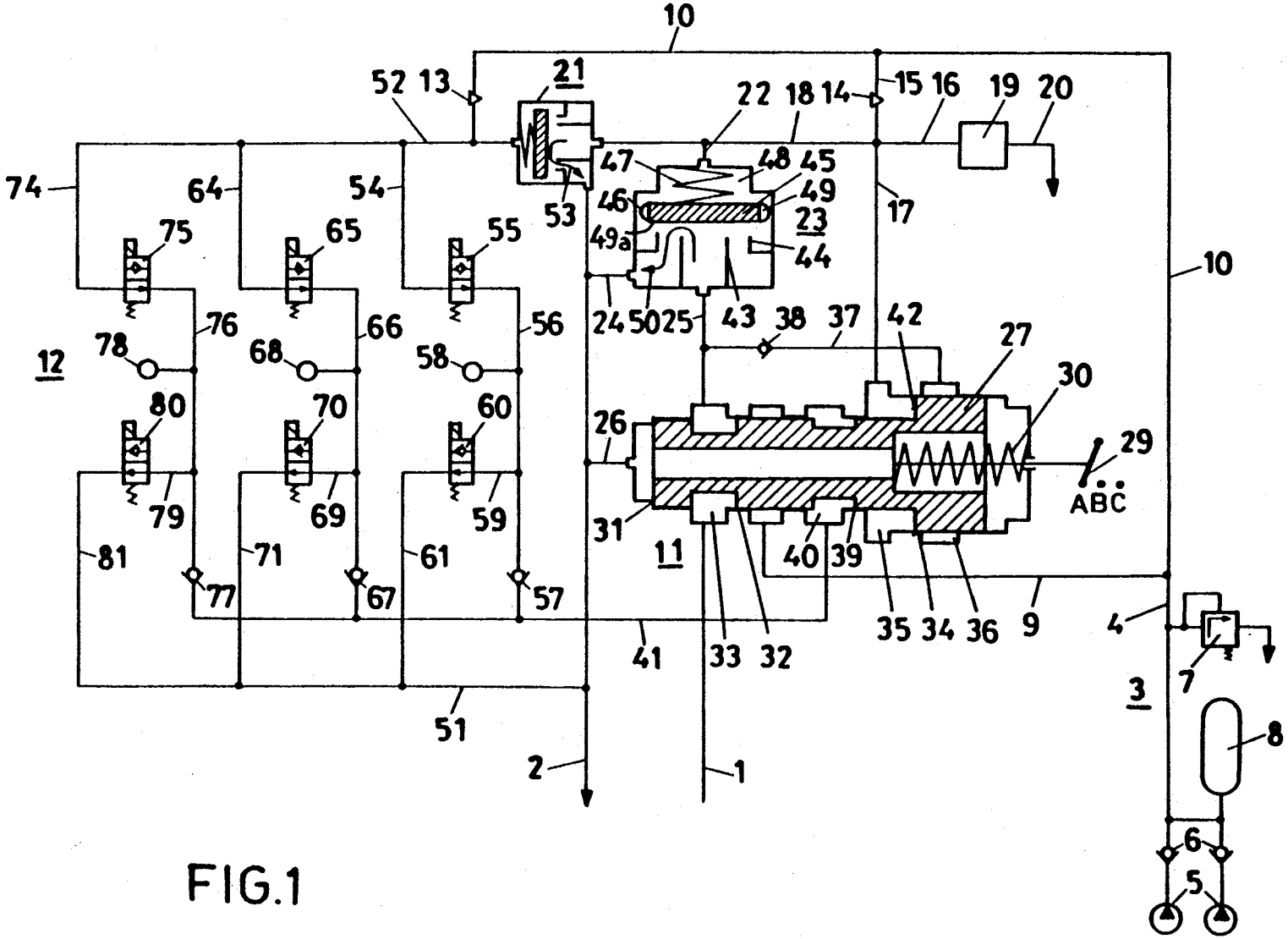
FIG. 1 shows a first embodiment of the invention in the switched-off position.

Referring now to the drawings, wherein like reference numerals designate identical or corresponding parts throughout the several views, FIG. 1 shows a supply circuit for a two-tube hydraulic system, through which a hydraulic fluid can be fed into a main line 1, in the unpressurized state. This main line 1 leads, for example, to drives (not shown) of quick-closure valves and steam control valves, which control the steam feed to a steam turbine (likewise not shown) in a known manner, in dependence on primary plant instrumentation and control. The backflow of hydraulic fluid runs into an outflow which is not shown. The supply circuit is also connected to this outflow by a line 2. The hydraulic fluid from the outflow is pressurized by a pressure generation device 3 and introduced through the line 4 into the supply circuit. The pressure generation device has two pumps 5, of which, however, only one is as a rule in operation, and which feed the hydraulic fluid into the line 4 via a check valve in each case. By means of a known excess pressure limiter 7, the pressure in the line 4 is limited. A pressure accumulator 8 connected to the line 4 prevents pressure fluctuations when there is a switch-over from one of the pumps 5 to the other one.

The line 4 divides into two lines 9 and 10. The line 9 leads to a connecting valve 11 designed as a slide valve, and the line 10 leads into a safety deactivation unit 12. In the line 10, an orifice plate 13 is provided for limiting the rate of the hydraulic fluid flowing in. A line 15 provided with an orifice plate 14 branches off from line 10. Downstream of the orifice plate 14, the line 15 branches into three further lines 16, 17 and 18. The line 16 leads, for example, to a mechanical overspeed monitor 19 fitted on the steam turbine and here indicated only diagrammatically. From this overspeed monitor 19, a line 20 leads into the outflow. The line 17 leads to the connecting valve 11 which is designed as an element of the safety deactivation unit 12. From the line 18, a line 22 branches off, which ends in a plate valve 23. The plate valve 23 has an outlet which is connected via a line 24 to the line 2 leading into the outflow. In addition, the plate valve 23 has an inlet which is connected via a line 25 to the connecting valve 11. One outlet of the connecting valve 11 is connected via a line 26 to the line 2. Hydraulic fluid which has penetrated through leakage points is removed from the connecting valve 11 through the line 26 into the outflow.

The connecting valve 11 has a slide 27 which is coupled with a mechanical position indicator and/or with an electrical position indicator 29. The electrical position indicator 29 here shows the end position A in the unpressurized, i.e. completely deactivated, state of the connecting valve 11. A valve spring 30 forces the slide 27 to the left against a stop 31 into the end position A shown in the drawing. In this end position, a main control edge 32 seals the connection between the line 9 leading in and the line 1 leading out. The line 25, which connects the connecting valve 11 to the plate valve 23, also starts from the same valve volume 33 from which the line 1 starts. In addition, the connecting valve 11 has a filling control edge 34 which, in the end position A, seals off a valve volume 35, in which the line 17 ends, from a valve volume 36. The valve volume 36 is connected to the line 25 via a line 37 which is provided with a check valve 38. The check valve 38 allows a flow of the hydraulic fluid in the direction of the line 25. In addition, the connecting valve 11 has a test control edge 39 which, in the end position A, seals off a valve volume 40 from the valve volume 35. From the valve volume 40, a line 41 leads to the safety deactivation unit 12.

The main control edge 32, the filling control edge 34 and the test control edge 39 delimit piston surfaces each provided on the slide 27, the piston surface 42 associated with the filling control edge 34 being greater than the other piston surfaces. In addition, the filling control edge 34 has a greater external diameter than the other control edges 32 and 39. The housing of the connecting valve 11 of cylindrical shape is sketched only roughly in contour. The connecting value 11, the plate valve 23 and the safety deactivation unit 2 are advantageously combined into a monolithic valve block, in order thus to obtain the shortest control lines and hence few dead volumes, whereby advantageously high dynamics of the supply circuit are obtained.

The plate valve 23 has two valve seats 43, 44, which can be arranged concentrically. In the closed state of the plate valve 23, the valve seats 43, 44 are closed by a valve plate 45. The valve plate 45 has a toric shaped outer edge 46, which makes jamming of the valve plate 45 impossible. The valve plate 45 is forced by a spring element 47 in the direction of the valve seats 43, 44. The spring element 47 is located in a volume 48 filled with hydraulic fluid. When the plate valve 23 is open, the hydraulic fluid must rapidly flow around the valve plate 45 and, in order to facilitate and accelerate this flow, the outer edge of the valve plate 45 is interrupted by connection slots 49. The function of the connection slots 49 can also be taken up by connection bores 49*a*, and a combination of the two designs is also possible. The connection slots 49 or the connection bores 49*a* are always arranged in the region outside the valve seat 44. Depending on the construction of the plate valve 23, it is also possible to the connection slots 49 or the connection bores 49*a*. An arrow 50 indicates the flow of the hydraulic fluid when the plate valve 23 is open, and the hydraulic fluid flowing in through the line 25 leaves the plate valve 23 through the lines 24 and 2 in the direction of the outflow.

The line 10 leads into one side of the safety deactivation unit 12, and the line 41 into the other side, and the unit is in addition connected via a line 51 to the line 2 and, via the latter, to the outflow. The line 10 leads into a line 52 which is connected to the plate valve 21. The plate valve 21 is of similar construction to the plate valve 23 already described. The line 52 leads into the volume of the plate valve 21 in which a valve spring is located which acts on a valve plate in the closing direction towards two valve seats. The plate valve 21 is shown in the open state. An arrow 53 indicates how the hydraulic fluid flows through this plate valve 21, serving as an outflow amplifier, from the line 18 leading in into the line 2 leading out into the outflow. From the line 52, a line 54 branches off, which leads to a solenoid valve 55. Downstream of the solenoid valve 55, a line 56, in which a check valve 57 is provided, leads into the line 41. The check valve 57 allows a flow of the hydraulic fluid from the line 41 into the line 56. In the region between the solenoid valve 55 and the check valve 57, the line 56 is provided with a pressure sensor 58, and additionally a line 59 leading to a solenoid valve 60 branches off in this region. A line 61 connected to the line 51 leads away from the solenoid valve 60.

From the line 52, a line 64 branches off, which leads to a solenoid valve 65. Downstream of the solenoid valve 65, a line 66, in which a check valve 67 is provided, leads into the line 41. The check valve 67 allows a flow of hydraulic fluid from the line 41 into the line 66. In the region between the solenoid valve 65 and the check valve 67, the line 66 is provided with a pressure sensor 68, and additionally a line 69 leading to a solenoid valve 70 branches off in this region. A line 71 connected to the line 51 leads away from the solenoid valve 70.

From the line 52, a line 74 branches off, which leads to a solenoid valve 75. Downstream of the solenoid valve 75, a line 76, in which a check valve 77 is provided, leads into the line 41. The check valve 77 allows a flow of hydraulic fluid from the line 41 into the line 76. In the region between the solenoid valve 75 and the check valve 77, the line 76 is provided with a pressure sensor 78, and additionally a line 79 leading to a solenoid valve 80 branches off in this region. A line 81 connected to the line 51 leads away from the solenoid valve 80.

The solenoid valves 55, 65, 75, 60, 70, 80 of the safety deactivation unit 12 are arranged as a hydraulic 2-out-of-3 circuit. They have two switching positions, on the one hand a position in which the hydraulic fluid is allowed to pass and, on the other hand, a blocking position. If the voltage applied to the actuation magnets of these valves should fail, the diagrammatically indicated springs force these valves into the position shown in FIG. 1, in which the hydraulic fluid is allowed to pass. The blocking position of the solenoid valves 55, 65, 75 does not allow any passage of hydraulic fluid from the line 52 in the direction of the line 41. The blocking position of the solenoid valves 60, 70, 80 does not allow any passage of hydraulic fluid in the direction of the line 51.

Figure 2:
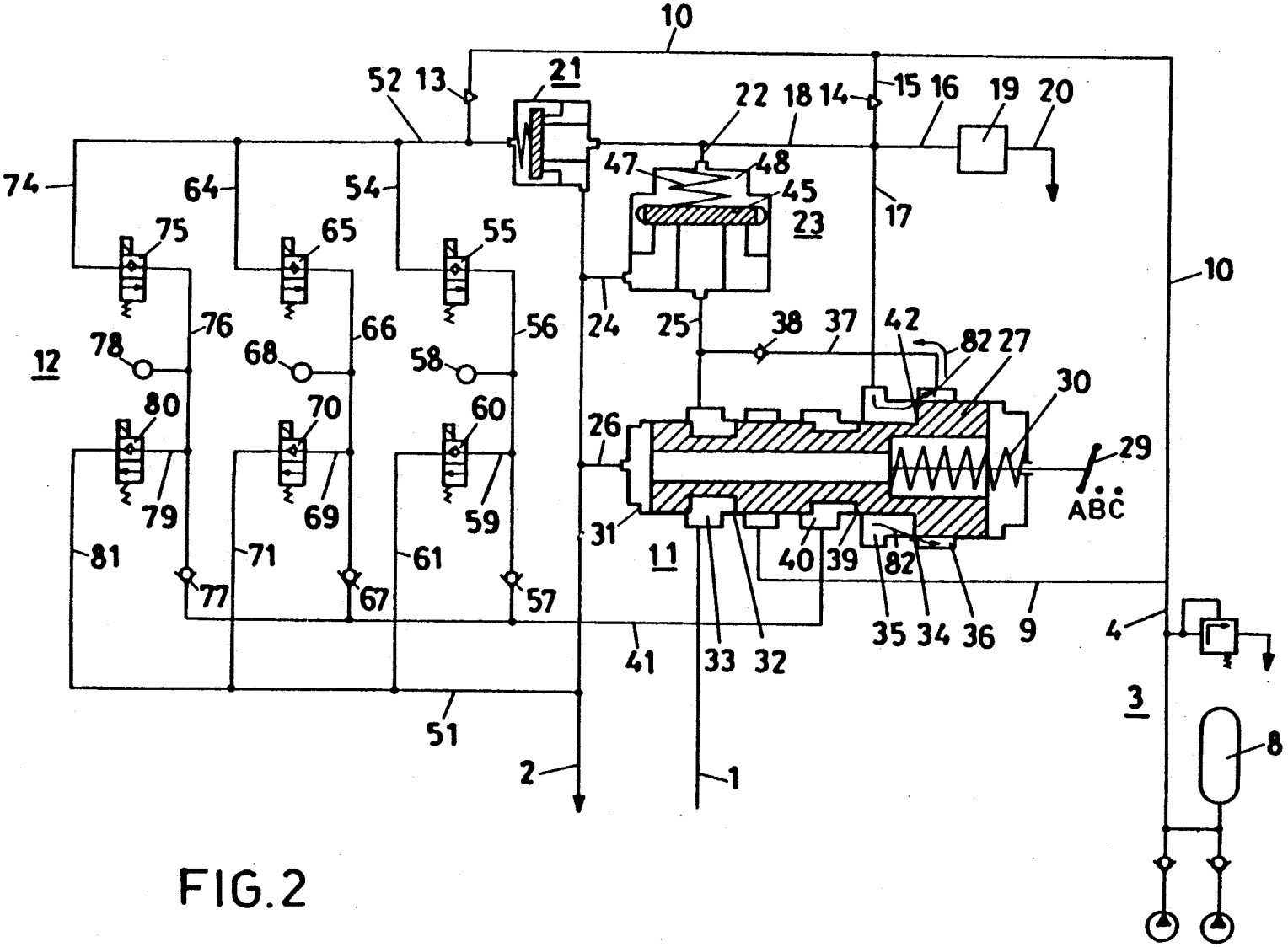
FIG. 2 shows a first embodiment of the invention in the filling position.

FIG. 2 shows the supply circuit during filling of the system. The solenoid valves 55, 65, 75, 60, 70, 80 are excited and are each forced by the magnets against the force of their springs into the blocking position. The safety deactivation unit 12 is filled via the orifice plate 13 with hydraulic fluid. The plate valve 21 is also closed and blocks the outflow of hydraulic fluid into the line 2. Through the lines 10, 15, the orifice plate 14 and the line 17, hydraulic fluid is fed into the valve volume 35 of the connecting valve 11. The pressure in the valve volume 35 acts on the piston surface 42 and forces the slide 27 slightly to the right, so that the filling control edge 34 engages. Arrows 82 indicate how the hydraulic fluid passes under control from the valve volume 35 into the valve volume 36 and from there on through the lines 37 and 25 into the closed plate valve 23 on the one hand and into the valve volume 33 of the connecting valve 11 and on into the main line 1 on the other hand.

Figure 3:
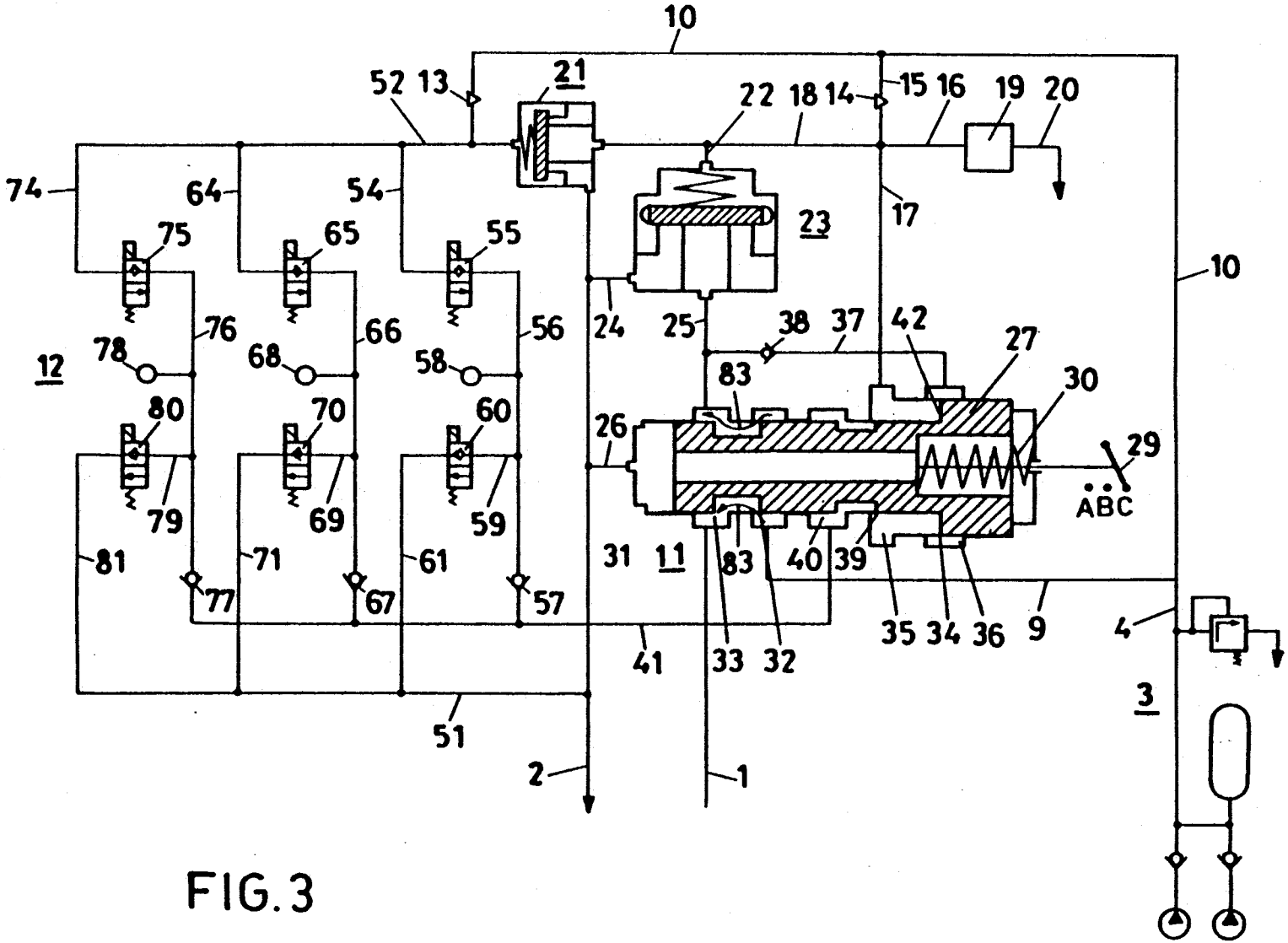
FIG. 3 shows a first embodiment of the invention in the operating position.

FIG. 3 shows the supply circuit in normal operation. The solenoid valves 55, 65, 75, 60, 70, 80 are excited and are in the blocking position. The plate valve 21 also blocks, and the plate valve 23 is also closed. The connecting valve 11 is completely open, i.e. the slide 27 is located so far to the right that the hydraulic fluid can flow unhindered directly from the line 9 into the valve volume 33 and from there on into the main line 1. The position indicator 29 indicates in this case the position C.

Figure 4:
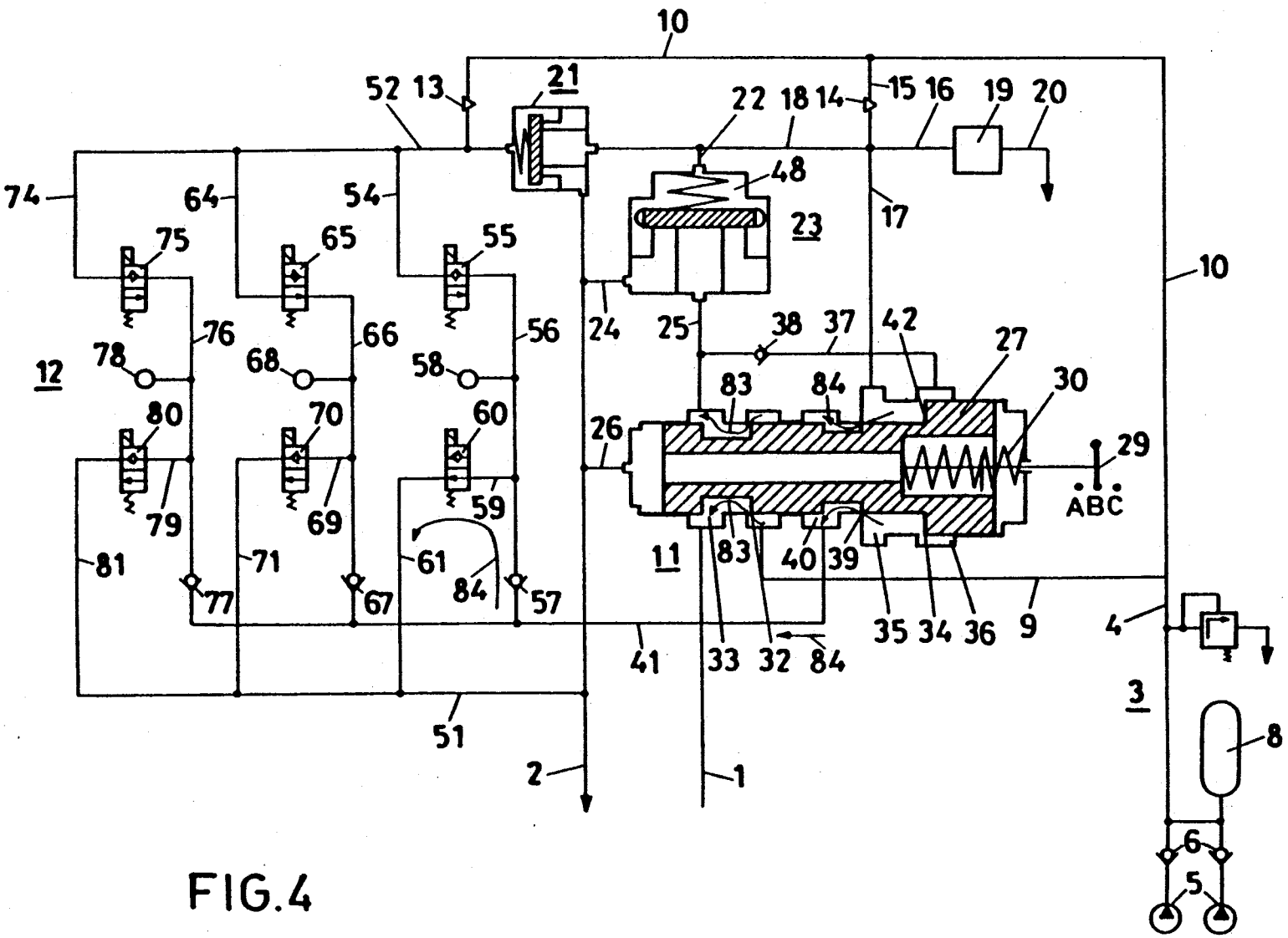
FIG. 4 shows a first embodiment of the invention in the testing position.

FIG. 4 shows the supply circuit in a test position. The solenoid valves 55 and 75, 70 and 80 are excited and are in the blocking position, but the solenoid valves 60 and 65 are deactivated and allow the hydraulic fluid to flow through. However, no hydraulic fluid can in this case flow through the solenoid valve 65, since the solenoid valve 70 and the check valve 67 are blocking. However, hydraulic fluid flows out of the line 41 through the solenoid valve 60 into the outflow, as indicated by the arrow 84. The valve volume 40 is relieved through the line 41 and the slide 27 of the connecting valve 11 moves to the left until the test control edge 39 engages and stops further flow of the hydraulic fluid from the valve volume 35 into the valve volume 40. In the valve volume 35, pressure builds up again, which acts on the piston surface 42 and holds the slide 27 in the position shown. The position indicator 29 indicates the position B. In this position B, further flow of hydraulic fluid from the line 9 into the valve volume 33 and on into the main line 1 is not impeded, as the arrows 83 indicate, so that faultless operation of the supply circuit during the test procedure is always ensured.

Figure 5:
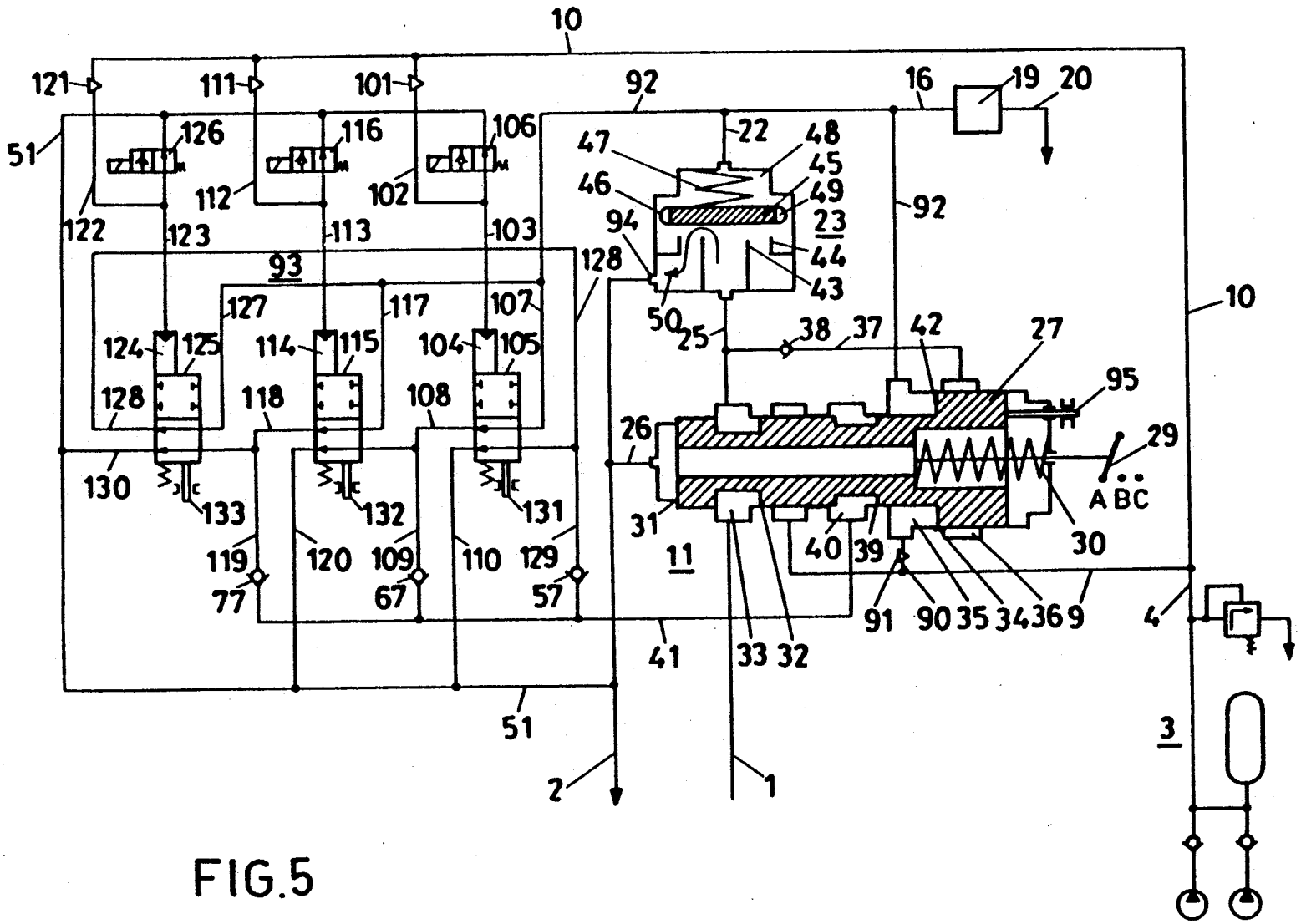
FIG. 5 shows a second embodiment of the invention in the switched-off position.

FIG. 5 shows a second embodiment of a supply circuit for a two-tube hydraulic system in the unpressurized state. The connecting valve 11 and the plate valve 23 are arranged in the same way as in FIGS. 1 to 4. The feeding of the hydraulic fluid, which is provided by the pressure generation device 3, takes place through the line 9 and a line 90 provided with an orifice plate 91 into the valve volume 35 of the connecting valve 11. A line 92 connects the valve volume 35 to a safety deactivation unit 93. From the line 92, a line 16 branches off which, for example, leads to a mechanical overspeed monitor 19 fitted to the steam turbine which is not shown. From this overspeed monitor 19, a line 20 leads into the outflow. From the line 92, a line 22 branches off which ends in the volume 48 of the plate valve 23. The plate valve 23 has already been described in connection with FIG. 1. One outlet 94 of the plate valve 23 leads directly into the line 2. The inlet of the plate valve 23 is, as already described, actively connected via the line 25 to the connecting valve 11. The connecting valve 11 is of the same structure as the valve already described in connection with FIGS. 1 to 4. The only difference here is that a mechanical position indicator 95 has additionally been fitted to the slide 27, so that the position of the slide 27 at any time can be read off directly outside the valve. The line 41 connects the valve volume 40 of the connecting valve 11 to the safety deactivation unit 93.

The line 10 connects the safety deactivation unit 93 to the pressure generation device 3. Three lines 102, 112, 122 provided with a flow-limiting orifice plate 101, 111, 121 respectively branch off from the line 10 and lead into a line 103, 113, 123 respectively. The lines 103, 113, 123 connect a drive volume 104, 114, 124 of a valve 105, 115, 125 respectively in each case to a solenoid valve 106, 116, 126. In FIG. 5, the solenoid valves 106, 116, 126 are shown in the unexcited state, and in this case they are forced by the diagrammatically indicated springs into the position drawn. The outlets of the solenoid valves 106, 116, 126 lead into the line 51. The valves 105, 115, 125, which each have a blocking position and a position which allows passage of hydraulic fluid, are combined into a hydraulic 2-out-of-3 circuit. The blocking position has two parallel, but interrupted channels, and two parallel channels are also provided in each case for allowing hydraulic fluid to pass through the valves 105, 115, 125. In the valves 105, 115, 125, the line connections of the right-hand side are defined as inlets, and the line connections on the left-hand side are defined as outlets, and in addition an upper and a lower channel are marked in each case.

From the line 92 leading in, three lines 107, 117, 127 branch off, which lead to the upper inlet of the associated valves 105, 115, 125 respectively, the line 107 leading to the valve 105, the line 117 to the valve 115 and the line 127 to the valve 125. From the upper outlet of the valve 105, a line 108 leads away, which connects this outlet to the lower inlet of the valve 115. From the line 108, a line 109 branches off, which leads into the line 41. In the line 109, a check valve 67 is provided which allows inflow of hydraulic fluid from the line 41. From the lower outlet of the valve 115, a line 120 leads into the line 51. From the upper outlet of the valve 115, a line 118 leads away, which connects this outlet to the lower inlet of the valve 125. From the line 118, a line 119 branches off, which leads into the line 41. In the line 119, a check valve 77 is provided which allows inflow of hydraulic fluid from the line 41. From the lower outlet of the valve 125, a line 130 leads into the line 51. From the upper outlet of the valve 125, a line 128 leads away, which connects this outlet to the lower inlet of the valve 105. From the line 128, a line 129 branches off, which leads into the line 41. In the line 129, a check valve 57 is provided which allows inflow of hydraulic fluid from the line 41. From the lower outlet of the valve 105, a line 110 leads into the line 51.

The valves 105, 115, 125 are provided with a mechanical position indicator 131, 132, 133 respectively, which is indicated only diagrammatically. This position indicator 131, 132, 133 allows a visual check of the valve position on site. The valves 105, 115, 125, the solenoid valves 106, 116, 126, the check valves 57, 67, 77, the plate valve 23 and the connecting valve 11 are combined to give a monolithic valve block, whereby advantageously short connecting lines between the valves and hence likewise small dead volumes are formed, so that the dynamics of the supply circuit can be advantageously enhanced. Moreover, the number of possible leakage points, and hence also the fire risk when oil is used as the hydraulic fluid, is advantageously reduced thereby.

Figure 6:
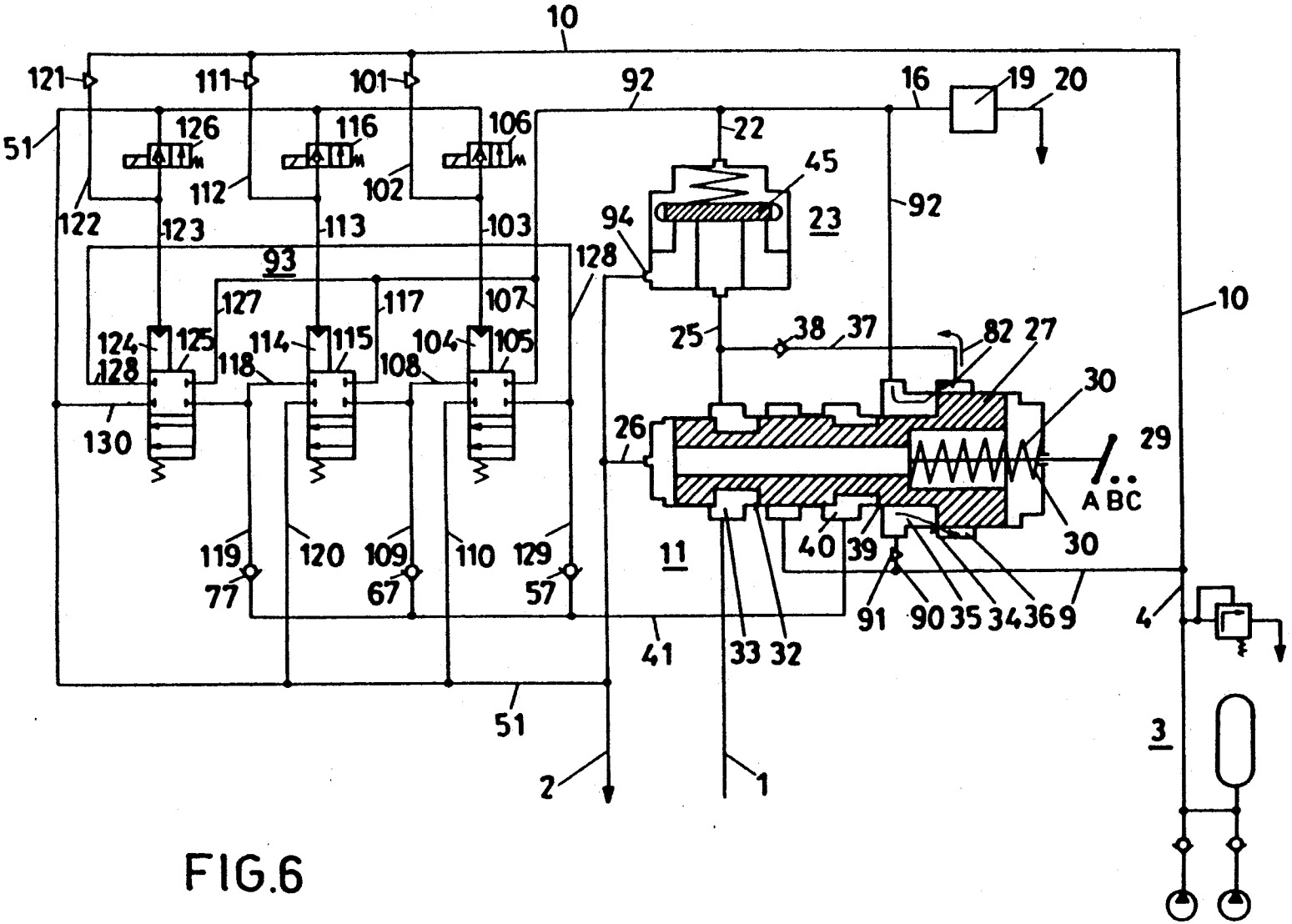
FIG. 6 shows a second embodiment of the invention in the filling position.

FIG. 6 shows the supply circuit variant according to FIG. 5 during filling of the system. The position indicators on the valves 105, 115, 125 and on the connecting valve 11 are here no longer shown in the drawing. The solenoid valves 106, 116, 126 of the safety deactivation unit 93 are excited and are forced by the magnets against the force of their springs into their position shown, in which the hydraulic fluid fed through the lines 102, 112, 122 acts on the drive volumes 104, 114, 124, since it cannot flow off into the line 51. As a result, the valves 105, 115, 125 are moved into the blocking position shown, against the force of their springs.

The plate valve 23 is closed, so that no hydraulic fluid can flow off into the line 2. Hydraulic fluid is fed into the valve volume 35 of the connecting valve 11 through the lines 9. 90 and the orifice plate 91. The orifice plate 91 limits the flow rate of the hydraulic fluid. The pressure in the valve volume 35 forces the slide 27 slightly to the right, so that the filling control edge 34 engages. The arrows 82 indicate how the hydraulic fluid passes under control from the valve volume 35 into the valve volume 36 and from there on through the lines 37 and 25 on the one hand into the closed plate valve 23 and, on the other hand, into the valve volume 33 and on into the main line 1.

Figure 7:
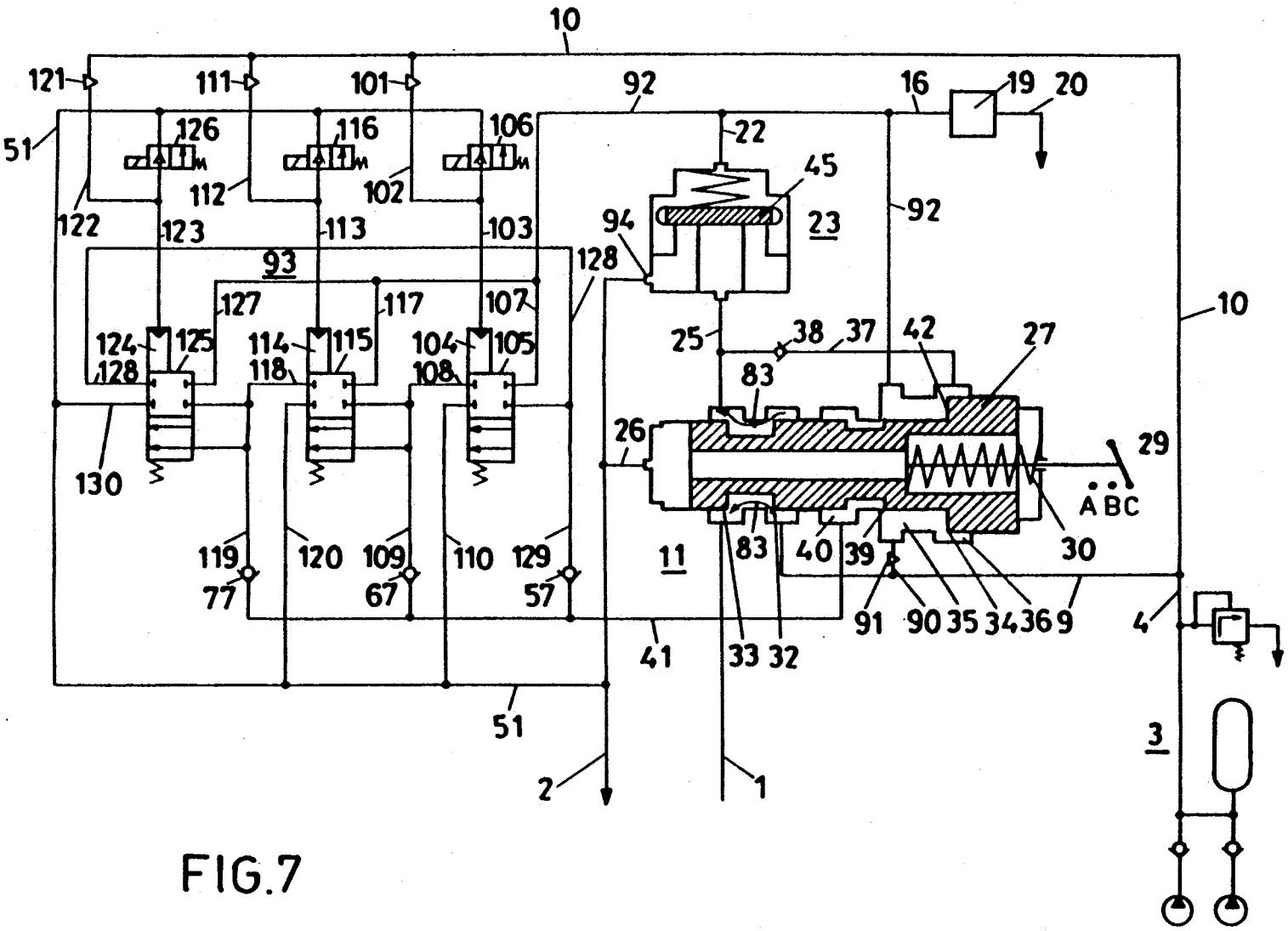
FIG. 7 shows a second embodiment of the invention in the operating position.

FIG. 7 shows the supply circuit according to FIG. 5 in normal operation. The position indicators on the valves 105, 115, 125 and on the connecting valve 11 are here no longer shown in the drawing. The solenoid valves 106, 116, 126 of the safety deactivation unit 93 are excited and are forced by the magnets into the position shown and block the outflow of hydraulic fluid. The plate valve 23 is also closed. The connecting valve 11 is completely open, so that the hydraulic fluid can flow unimpeded directly from the line 9 into the valve volume 33 and from there on into the main line 1. In this case, the position indicator 29 indicates the position C.

Figure 8:
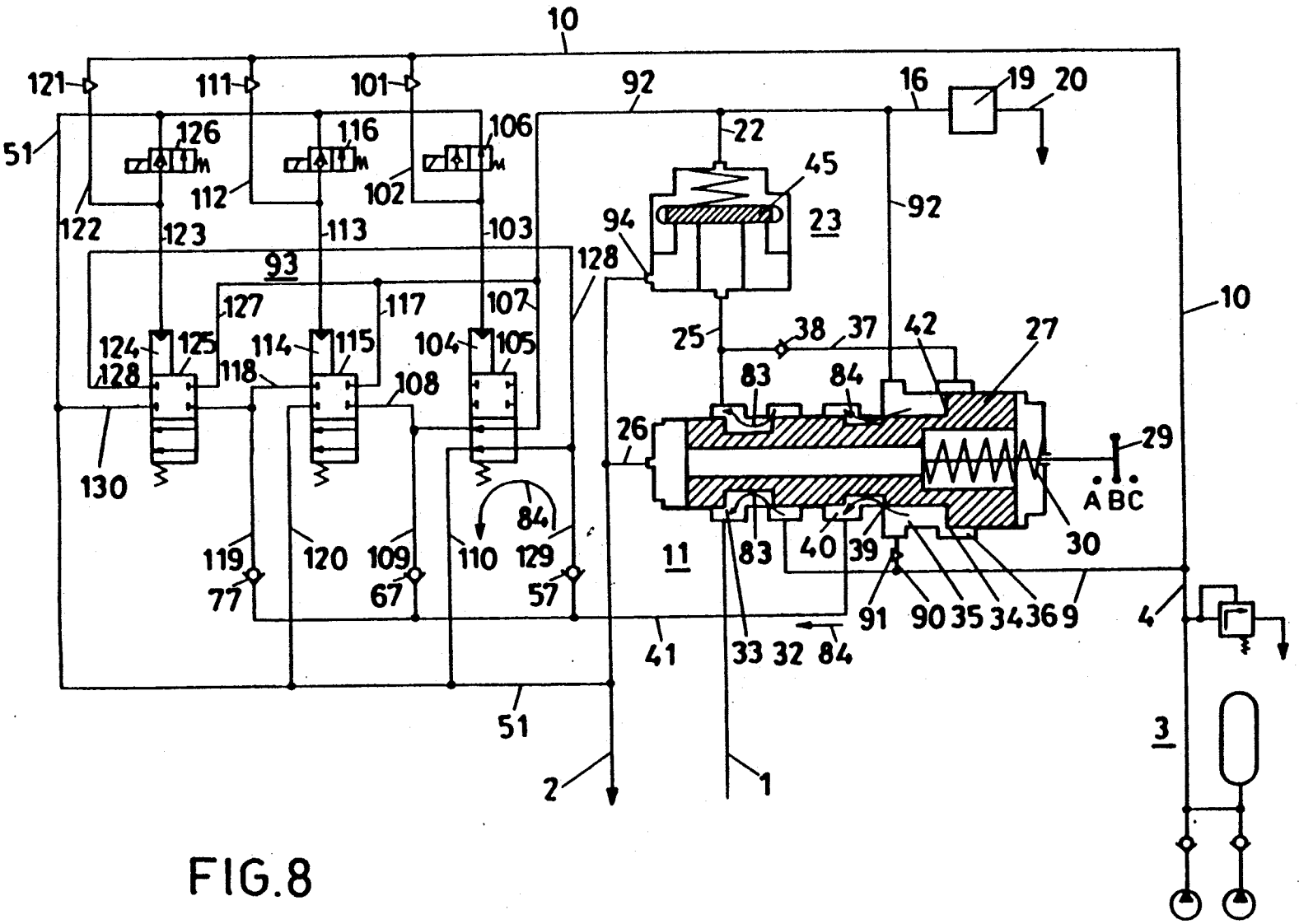
FIG. 8 shows a second embodiment of the invention in the testing position.

FIG. 8 shows the supply circuit according to FIG. 5 in a test position. The solenoid valves 116 and 126 are excited and block the outflow of hydraulic fluid, so that the valves 115 and 125 are also held in the blocking position shown by the pressure in their drive volumes 114 and 124. However, the solenoid valve 106 is deactivated and has been forced by its spring into the position shown, in which the hydraulic fluid can flow off into the line 51. As a result, the drive volume 104 of the valve 105 is also depressurized via the line 103, so that the valve 105 is forced by its spring into the position shown.

From the upper channel of the valve 105, however, no hydraulic fluid can flow out, since the valve 115 and the check valve 67 block this path. From the lower channel, however, hydraulic fluid can flow out from the line 41 through the line 110 into the lines 51 and 2 and hence into the outflow, as indicated by an arrow 84. The valve volume 40 is relieved through the line 41, and the slide 27 of the connecting valve 11 moves to the left until the test control edge 39 engages and deactivates the further flow of hydraulic fluid from the valve volume 35 into the valve volume 40. The direction of flow of hydraulic fluid is indicated by the arrows 84. The position indicator 29 indicates position B. In this position B, the further flow of hydraulic fluid from the line 9 into the valve volume 33 and on into the main line 1 is not impeded, as indicated by the arrows 83, so that fault-free operation of the supply circuit during the test procedure is always ensured.

Figure 9:
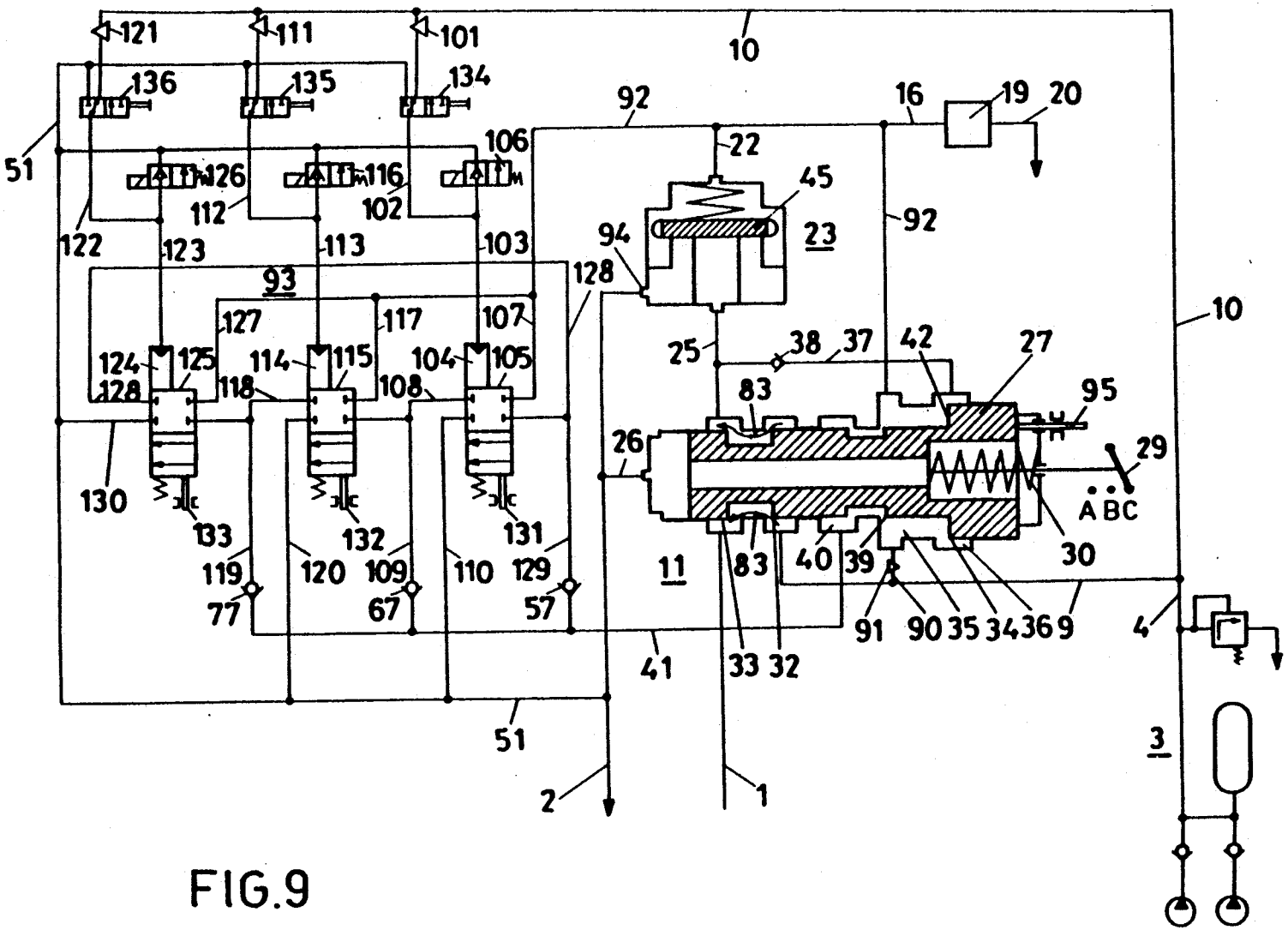
FIG. 9 shows a third embodiment of the invention in the operating position.

FIG. 9 shows a third embodiment of a supply circuit for a two-tube hydraulic system in normal operation. This embodiment differs from the corresponding one according to FIGS. 5 to 8 only by the insertion of a hand-operable valve 134, 135, 136 into the lines 102, 112, 122 respectively. The valve 134 is provided in the line 102, the valve 135 in the line 112 and the valve 136 in the line 122. These valves 134, 135, 136 have a capability for through-flow in thc position shown, which permits feeding of hydraulic fluid through the particular associated line 102, 112, 122. These valves additionally have a second switching position, in which draining of hydraulic fluid from the particular associated line 102, 112, 122 into the line 51 is possible. The valves 134, 135, 136 allow replacement of the downstream solenoid valves 106, 116, 126 without problems, only one of these valves always being changed in each case. During such a change, the slide 27 of the connecting valve 11 moves into the test position B. A further description of the various types of operation is unnecessary, since this embodiment corresponds in other respects to that described in connection with FIGS. 5 to 8.

To explain the mode of action, FIGS. 1 to 4 are now considered in more detail. The supply circuit is constructed in such a way that occurrence of pressure surges is avoided with high certainty since, in the different states of operation, solely the connecting valve 11 determines the f low of hydraulic fluid into the main line 1. The connecting valve 11 is designed as a slide valve, whose slide 27 is provided with various control edges, by means of which the flow conditions can be influenced in a particularly sensitive way. The slide of a slide valve can, however, also jam, particularly if oil is used as the hydraulic fluid. Such jamming or other seizing of the slide 27 in the connecting valve 11 has no effect in this case with respect to the deactivation safety of the complete arrangement. Deactivation of the arrangement, i.e. a let-down of the pressure in the main line 1, is always possible, and in particular independently of the position of the slide 27 which may have seized.

The plate valve 23, the line 24 and the line 2 have such large passage cross sections that in every case the total quantity of the hydraulic fluid replenished through the lines 9 and 10, and simultaneously also the hydraulic fluid flowing back from the line 1, can be discharged into the outflow. The response of the plate valve 23 is triggered by a pressure drop in the line 18. This pressure drop can, for example, trigger a response of the overspeed monitor 19. It is also possible, however, that the safety deactivation unit 12 is triggered, whereby the plate valve 21 opens and discharges the pressure from the line 18, and via the line 22 also the pressure from the volume 48 of the plate valve 23, into the line 2 and on into the outflow, as indicated by the arrow 53 in FIG. 1. The safety deactivation unit 12 is designed as a 2-out-of-3 circuit, that is to say, for a trip, at least two of the three parallel circuit branches of the arrangement must be activated. The plate valve 23 is constructed simply with high reliability in operation, so that jamming of the valve plate 45 can be excluded with complete certainty. Accordingly, this supply circuit has very advantageously made it possible to exploit the advantages of a slide valve, without the weaknesses of the latter being able adversely to affect the safety of the overall system.

During filling according to FIG. 2, initially all lines in the system are filled comparatively slowly, the filling control edge 34 controlling the filling rate, while the rate of hydraulic fluid is limited by the orifice plate 14. The hydraulic fluid flows through the lines 10, 15 and 17 into the valve volume 35 and f lows past the filling control edge 34 into the valve volume 36 and from there on into the line 37; arrows 82 indicate this flow. The line 37 leads into the line 25 which, on the one hand, leads into the plate valve 23 and, on the other hand, into the valve volume 33 of the connecting valve 11. The spring element 47 holds the plate valve 23 closed. From the valve volume 33, the hydraulic fluid flows on into the main line 1, in which a pressure is gradually built up when all the connected volumes have been filled. There is no question of pressure surges during this comparatively slow build-up of pressure. To the same extent to which the pressure builds up in the main line 1, pressure also builds up in the lines of the supply circuit, so that the plate valves 23 and 21 remain reliably closed during the filling procedure. As soon as the operating pressure has been reached, the slide 27 slides from the position shown in FIG. 2 into the position according to FIG. 3, where the hydraulic fluid can then f low directly f rom the line 9 into the valve volume 33 and on into the main line 1. Significant pressure surges which, for example, might adversely affect the turbine control, into the main line 1 are totally avoided in this way.

The risk of the slide 27 jamming can be reduced if this slide 27 is occasionally moved. A comparatively small test stroke suffices as a motion. The position indicator 29 indicates the position assumed by the slide 27. When the test stroke is then triggered, as shown in FIG. 4, and the position indicator 29 then indicates the desired position B, the connecting valve 11 operates without fault. If, however, the slide 27 should seize, this is detected by means of the position indicator which then does not indicate the correct position. At the next suitable time, an inspection of the connecting valve 11 can then be made. It is particularly advantageous that the supply circuit does not have to be shut down at once since, as already stated, such a fault has no adverse effects on the safety of the overall plant.

The above statements also apply analogously to the supply circuit according to FIGS. 5 to 8. This supply circuit has a safety deactivation unit 93, whose valves 105, 115, 125 have a larger cross section, so that higher rates of hydraulic fluid can be controlled directly, and an additional outflow amplifier at the outlet, like the plate valve 21, can therefore be advantageously omitted in this case. The valves each have a mechanical position indicator 131, 132, 133, which makes it possible to establish the position of the particular valve on site and thus to arrive more quickly at the answer in the event of any troubleshooting. In this embodiment again, the pressure between two neighboring valves, in this case in FIG. 8 between the valves 105 and 125, of the 2-out-of-3 circuit is used for triggering the test stroke of the connecting valve 11.

The supply circuit according to FIG. 9 differs from the above supply circuit only by the additional hand-operable valves 134, 135, 136. If one of these valves is switched over into the pass position, that one of the solenoid valves 106, 116, 126 which is directly downstream can be replaced without having to take the supply circuit out of operation. The operational availability of the supply circuit is thereby advantageously increased. As a result of this switch-over, a test stroke of the connecting valve 11 is initiated simultaneously, and the result of this action can immediately be checked on site by means of the mechanical position indicator 95 of the slide 27. Such an uncomplicated facility for checking is of great advantage to the plant personnel.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A supply circuit for a hydraulic valve control system for controlling a steam control valve, comprising:

pressure generating means for pressurizing a hydraulic fluid;

a slide valve actuated by the fluid pressure generating means;

main conduit means for controlling a control valve, the main conduit means being in fluid communication with the fluid pressure generating means through the slide valve, the slide valve being arranged to control a flow of fluid between the pressure generating means and the main conduit means;

the slide valve including a slide having three control edges which cooperate with valve volumes in the slide valve to control the flow of fluid through the valve, the control edges including a first filling control edge for regulating a circuit filling operation, a second main control edge for controlling the flow of fluid during normal operation of the circuit, and a third test control edge for regulating a test stroke of the slide without disrupting the control of normal operation by the slide valve, wherein the main control edge remains closed to the main conduit during the filling operation until an operating pressure in attained in the circuit and remains open during the test stroke;

a plate valve in fluid communication with the slide valve, the plate valve acting as an outflow amplifier for moving the slide to close the main control edge; and, a safety deactivation unit in fluid communication with the pressure generating device, the slide valve, and a fluid outflow for controlling the pressure in the slide valve and main conduit means and for activating the test stroke.

2. The supply circuit as claimed in claim 1, wherein, the slide valve includes a slide activated by the hydraulic flow flowing in, the slide being urged to an end position by a valve spring when the valve is unpressurized, and the slide is provided with an electrical position indicator for indicating a position of the slide in the valve.

3. The supply circuit as claimed in claim 1, wherein the safety deactivation unit is designed as a 2-out-of-3 circuit and can be activated electromagnetically.

4. The supply circuit as claimed in claim 3, wherein the safety deactivation unit has at least six solenoid valves connected to the 2-out-of-3 circuit, and the safety deactivation unit has, at one outlet, an additional plate valve which is in fluid communication with the plate valve to initiate an outflow action of the plate valve.

5. The supply circuit as claimed in claim 3, wherein the safety deactivation unit has at least three valves connected to the 2-out-of-3 circuit, and these valves, of which there are at least three, are designed each to be activated hydraulically by at least one solenoid valve.

6. The supply circuit as claimed in claim 5, wherein the valves are each provided with a mechanical position indicator.

7. The supply circuit as claimed in claim 5, wherein a hand-operable valve is provided in each case upstream of each of the solenoid valves of the safety deactivation unit.

8. The supply circuit as claimed in claim 1, wherein the plate valve has two seats subjected to a single valve plate, the valve plate has a toric shaped outer edge, and the valve plate is interrupted by at least one of connection slots in the outer edge of the valve plate and connection bores in the region outside the valve seats.

9. The supply circuit as claimed in claim 1 wherein the pressure between two neighboring valves of the safety deactivation unit is used for initiating the test stroke of the slide.

* * * * *